US006581223B1

(12) United States Patent
Wang

(10) Patent No.: US 6,581,223 B1
(45) Date of Patent: Jun. 24, 2003

(54) FOLDABLE FRAME ASSEMBLY

(76) Inventor: Cheng-Chung Wang, 12F, No. 440, Sec. 4, Jein Ai Rd., Taipei (TW)

( * ) Notice: Subject to any disclaimer, the term of this patent is extended or adjusted under 35 U.S.C. 154(b) by 0 days.

(21) Appl. No.: 10/176,935

(22) Filed: Jun. 21, 2002

(30) Foreign Application Priority Data

Mar. 12, 2002 (TW) ..... 091202884 U

(51) Int. Cl.[7] ..... A47C 17/72

(52) U.S. Cl. ..... 5/174; 5/111; 5/182; 5/185; 5/176.1

(58) Field of Search ..... 5/110, 111, 174–182, 5/185, 713

(56) References Cited

U.S. PATENT DOCUMENTS 7,712 A * 10/1850 Whitmarsh ..... 5/115
1,250,697 A * 12/1917 Strug ..... 297/106
3,064,667 A * 11/1962 Marino ..... 135/131
4,243,263 A * 1/1981 Thiboutot ..... 297/42
4,594,743 A * 6/1986 Owen et al. ..... 5/111
6,446,282 B1 * 9/2002 Wu ..... 5/115
6,457,192 B2 * 10/2002 Choi et al. ..... 5/114

* cited by examiner

*Primary Examiner*—Michael F. Trettel
(74) *Attorney, Agent, or Firm*—Webb Ziesenhiem Logsdon Orkin & Hanson, P.C.

(57) ABSTRACT

A foldable frame assembly includes a plurality of parallel frame members, each of which has left and right columns. A plurality of coupling units are alternately disposed with the frame members, and each includes first left and right connecting rods and second left and right connecting rods. Each of the first left and right connecting rods has a first upper rod end that is pivoted to the upper column end of a respective one of the left and right columns of one of two adjacent ones of the frame members, and a first lower rod end that is opposite to the first upper rod end. Each of the second left and right connecting rods has a second upper rod end that is pivoted to the upper column end of a respective one of the left and right columns of the other one of the two adjacent ones of the frame members, and a second lower rod end that is opposite to the second upper rod end and that is pivoted to the first lower rod end so as to permit folding and unfolding of the frame members relative to one another in the longitudinal direction.

12 Claims, 13 Drawing Sheets

FOLDABLE FRAME ASSEMBLY

CROSS-REFERENCE TO RELATED APPLICATION

This application claims priority of Taiwan patent Application No. 91202884, filed on Mar. 12, 2002.

BACKGROUND OF THE INVENTION

1. Field of the Invention

This invention relates to a foldable frame assembly, more particularly to a foldable frame assembly with a plurality of coupling units that permit folding of the foldable frame assembly to a relatively compact configuration to facilitate transport and storage of the foldable frame assembly.

2. Description of the Related Art

FIGS. 1 and 2 illustrate a conventional foldable frame assembly for a foldable bed. The foldable frame assembly includes a plurality of telescopic columns 8 which are arranged in rows and columns, which are interconnected by a plurality of connecting rods 9, and which are extendable in a vertical direction (indicated by reference numeral Z in FIG. 1). Two adjacent ones of the connecting rods 9 intersect, are pivoted to each other at the intersection, and have ends that are respectively pivoted to top and bottom ends of two respective ones of the telescopic columns 8 so as to be foldable in two lateral directions (indicated by reference numerals X and Y in FIG. 1).

The conventional foldable frame assembly is disadvantageous in that a relatively large quantity of the telescopic columns 8 is needed in order to provide a sufficient supporting area to avoid collapse of the foldable bed at regions among the top ends of the telescopic columns 8, which inevitably results in an increase in the number of the connecting rods 9 and the volume and the weight of the foldable frame assembly.

SUMMARY OF THE INVENTION

Therefore, the object of the present invention is to provide a foldable frame assembly that is capable of overcoming the aforementioned drawbacks.

Another object of this invention is to provide a foldable bed that includes the foldable frame assembly and an inflatable mattress.

According to one aspect of the present invention, there is provided a foldable frame assembly that comprises: a plurality of parallel frame members which are aligned in a longitudinal direction and each of which has left and right columns, each of the left and right columns extending in a vertical direction and having opposite upper and lower column ends that are telescopically movable toward and away from each other; and a plurality of coupling units which are alternately disposed with the frame members in the longitudinal direction and each of which includes first left and right connecting rods and second left and right connecting rods. Each of the first left and right connecting ros has a first upper rod end that is pivoted to the upper column end of a respective one of the left and right columns of one of two adjacent ones of the frame members, and a first lower rod end that is opposite to the first upper rod end. Each of the second left and right connecting rods has a second upper rod end that is pivoted to the upper column end of a respective one of the left and right columns of the other one of the two adjacent ones of the frame members, and a second lower rod end that is opposite to the second upper rod end and that is pivoted to the first lower rod end so as to permit folding and unfolding of the frame members relative to one another in the longitudinal direction.

According to another aspect of the present invention, there is provided a foldable bed that comprises: a foldable frame assembly, a belt unit, and an inflatable mattress. The foldable frame assembly includes: a plurality of parallel frame members, a plurality of coupling units, and a plurality of auxiliary supporting members. The frame members are aligned in a longitudinal direction, and each has left and right columns and parallel upper and lower beams. Each of the left and right columns extends in a vertical direction, and has opposite upper and lower column ends that are telescopically movable toward and away from each other. The upper and lower beams extend in a transverse direction, and interconnect the upper column ends of the left and right columns and the lower column ends of the left and right columns, respectively. Each of the coupling units includes first left and right connecting rods, second left and right connecting rods, third left and right connecting rods, fourth left and right connecting rods, left and right upper joints, left and right lower joints, and a cross-rod. Each of the first left and right connecting rods has a first upper rod end that is pivoted to the upper column end of a respective one of the left and right columns of one of two adjacent ones of the frame members, and a first lower rod end that is opposite to the first upper rod end. Each of the second left and right connecting rods has a second upper rod end that is pivoted to the upper column end of a respective one of the left and right columns of the other one of the two adjacent ones of the frame members, and a second lower rod end that is opposite to the second upper rod end and that is pivoted to the first lower rod end. Each of the third left and right connecting rods has a third upper rod end and a third lower rod end that is pivoted to the lower column end of a respective one of the left and right columns of said one of the two adjacent ones of the frame members, and intersects a respective one of the first left and right connecting rods. Each of the fourth left and right connecting rods has a fourth upper rod end that is pivoted to the third upper rod end, and a fourth lower rod end that is pivoted to the lower column end of a respective one of the left and right columns of the other one of the two adjacent ones of the frame members, and intersects a respective one of the second left and right connecting rods. The first and second lower rod ends are pivoted to each other via a respective one of the left and right lower joints. The third and fourth upper rod ends are pivoted to each other via a respective one of the left and right upper joints. The cross-rod interconnects the left and right lower joints. The auxiliary supporting members are respectively pivoted to the frame members, and each includes a post that is spaced apart from a respective one of the left and right columns in the transverse direction and that has upper and lower post ends, and parallel upper and lower rafters extending in the transverse direction. The upper rafter has two opposite ends respectively pivoted to the upper post end of the post and the upper column end of the respective one of the left and right columns. The lower rafter has two opposite ends respectively pivoted to the lower post end of the post and the lower column end of the respective one of the left and right columns. The belt unit includes a plurality of elastic belts which are arranged in rows and columns and which are detachably secured to the upper post ends of the posts. The inflatable mattress is detachably secured to the belt unit.

BRIEF DESCRIPTION OF THE DRAWINGS

In drawings which illustrate an embodiment of the invention.

DETAILED DESCRIPTION OF THE PREFERRED EMBODIMENT

Figure 1:
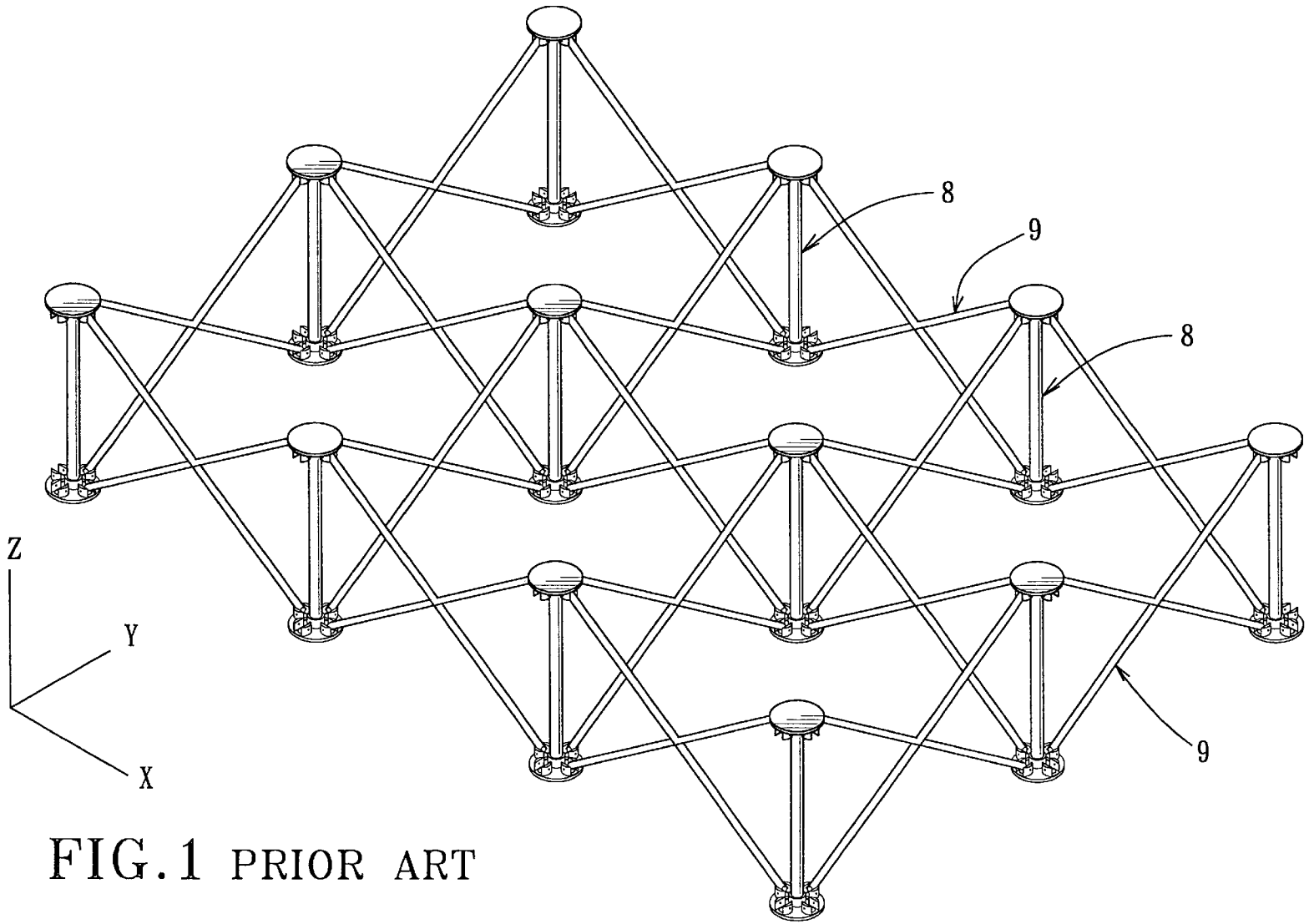
FIG. 1 PRIOR ART
FIG. 1 is a perspective view of a conventional foldable frame assembly in an extended position.
Figure 2:
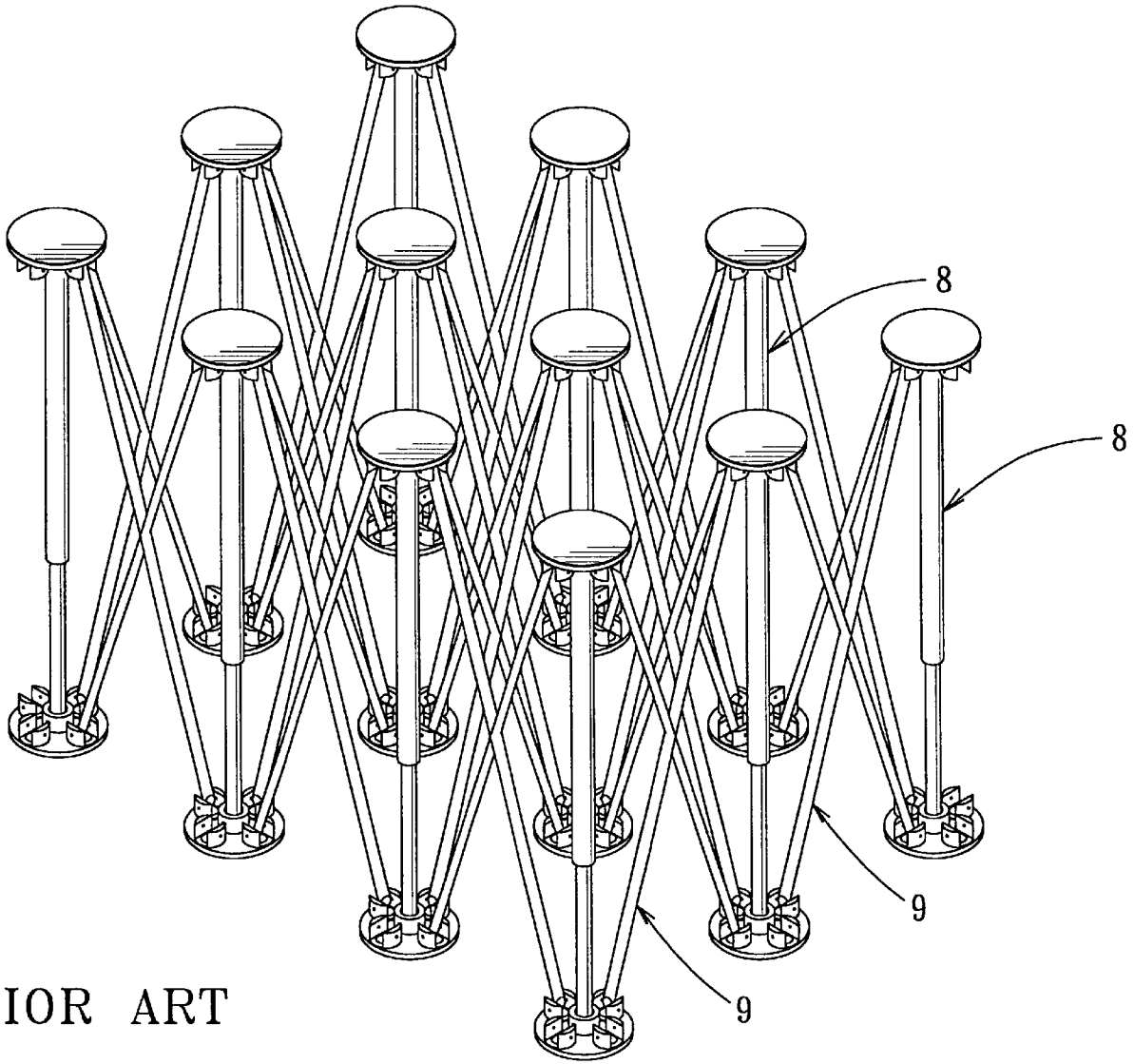
FIG. 2 PRIOR ART
FIG. 2 is a perspective view of the foldable frame assembly in a folded position.
Figure 3:
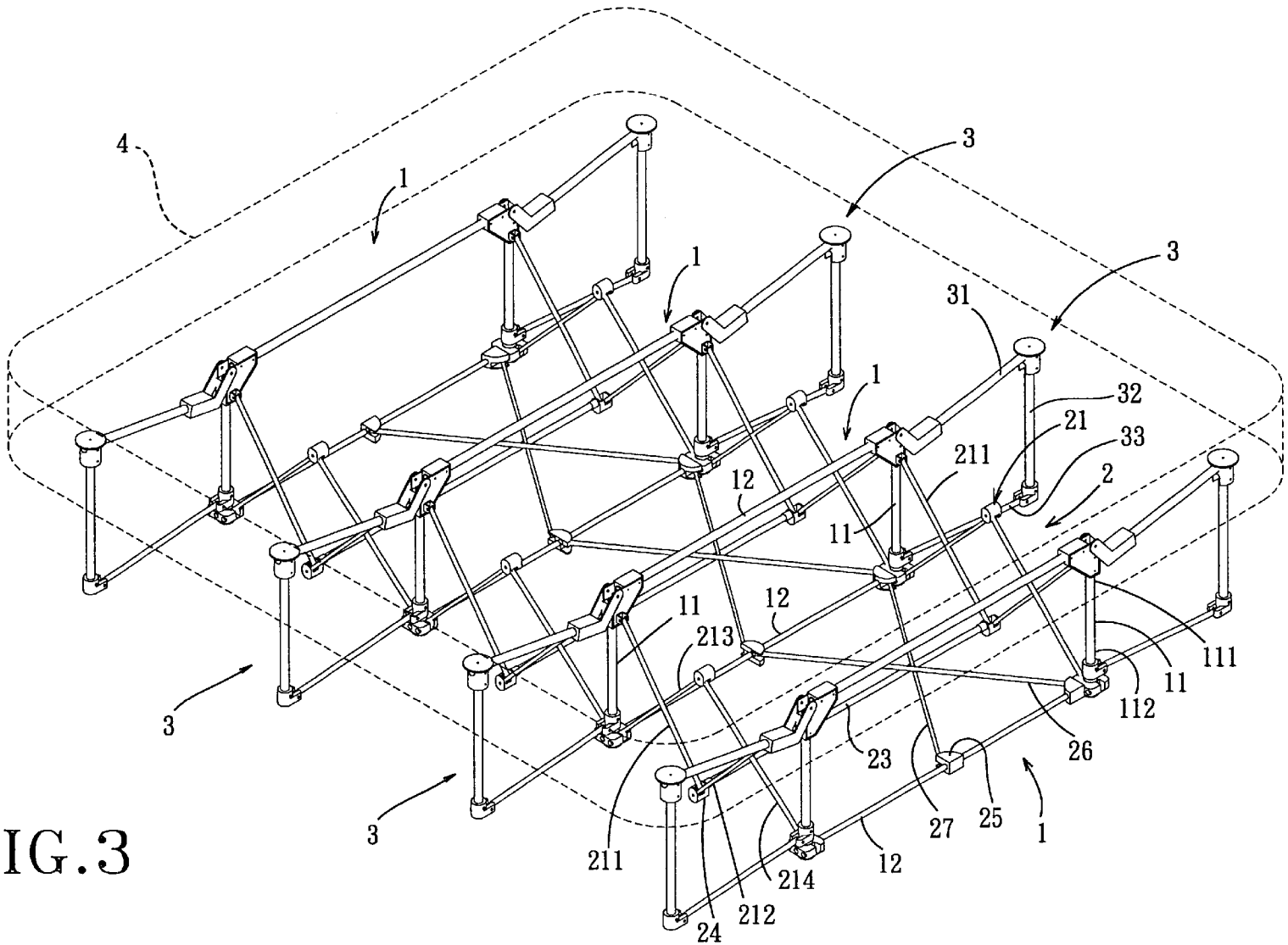
FIG. 3 is a perspective view of a foldable bed embodying this invention, in an extended position.
Figure 4:
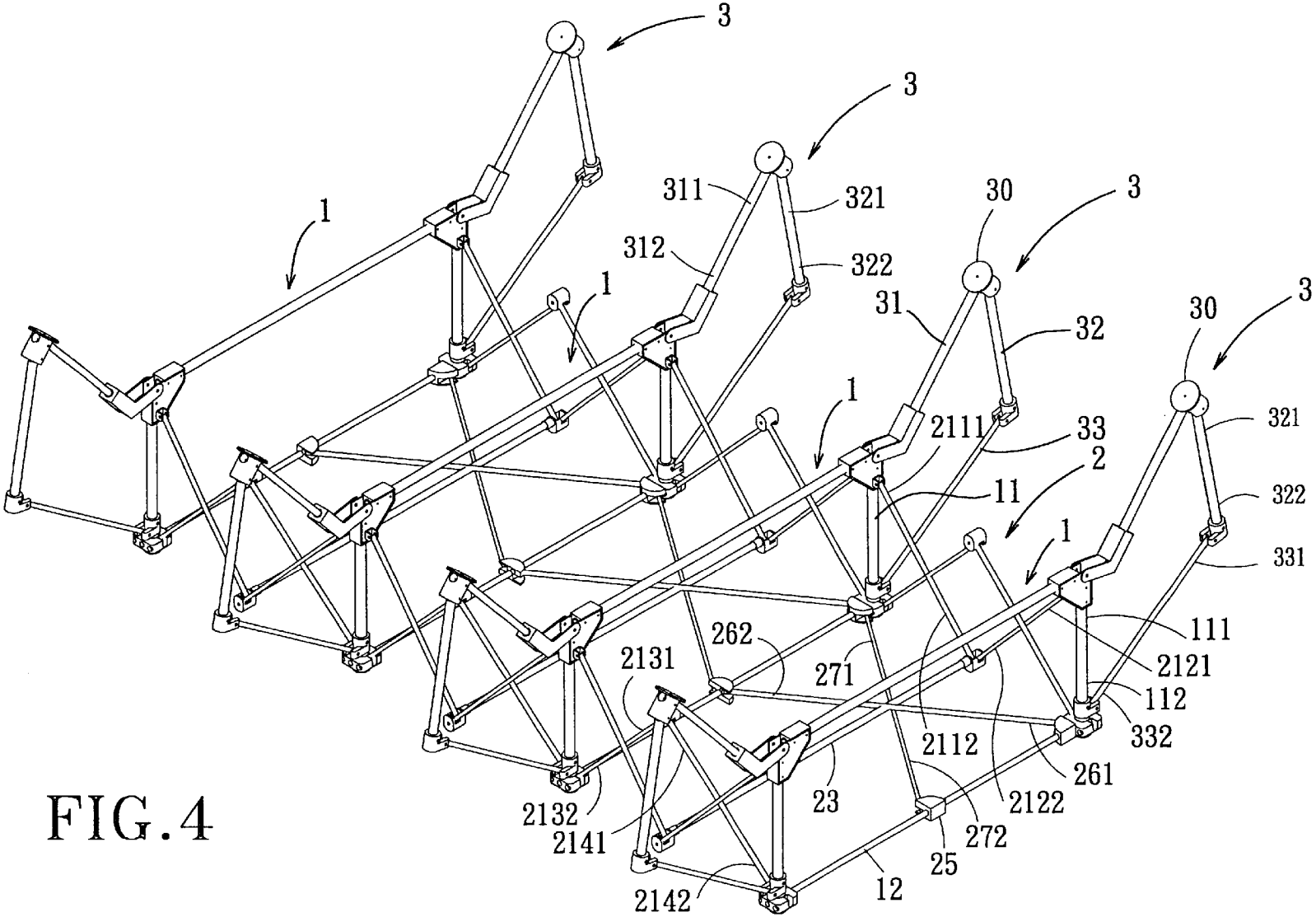
FIGS. 4 and 5 are perspective views to illustrate how a foldable frame assembly of the foldable bed of FIG. 3 is folded.
Figure 5:
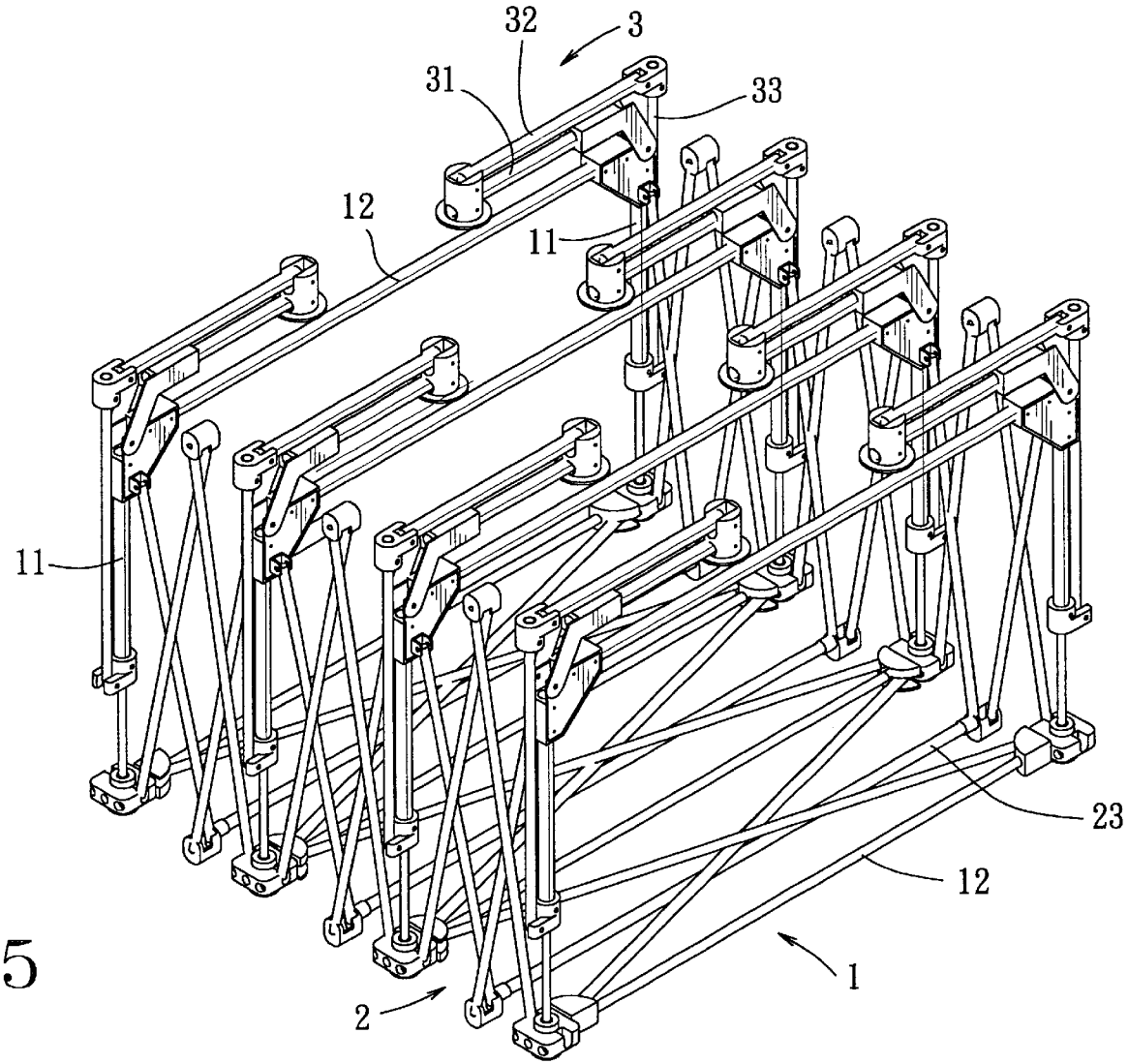
Figure 6:
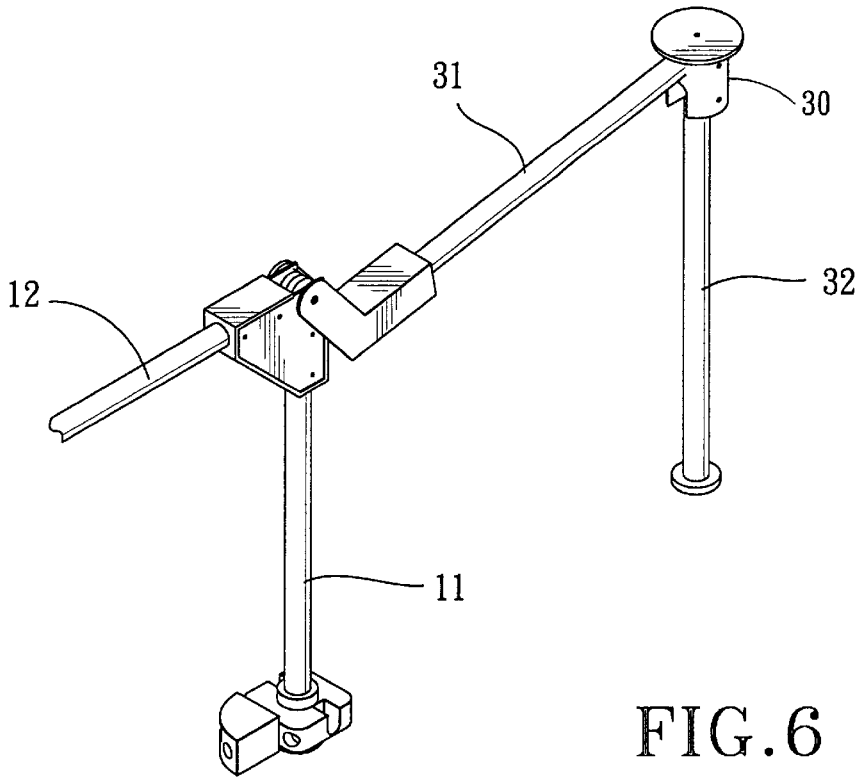
FIGS. 6 to 9 are fragmentary perspective views to illustrate how an auxiliary supporting member of the foldable frame assembly of FIG. 4 is designed in order to be foldable.
Figure 7:
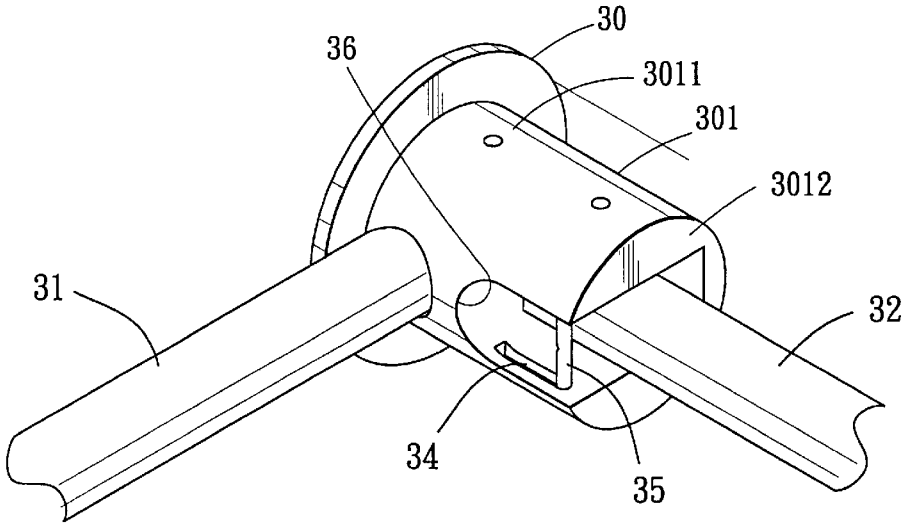
Figure 8:
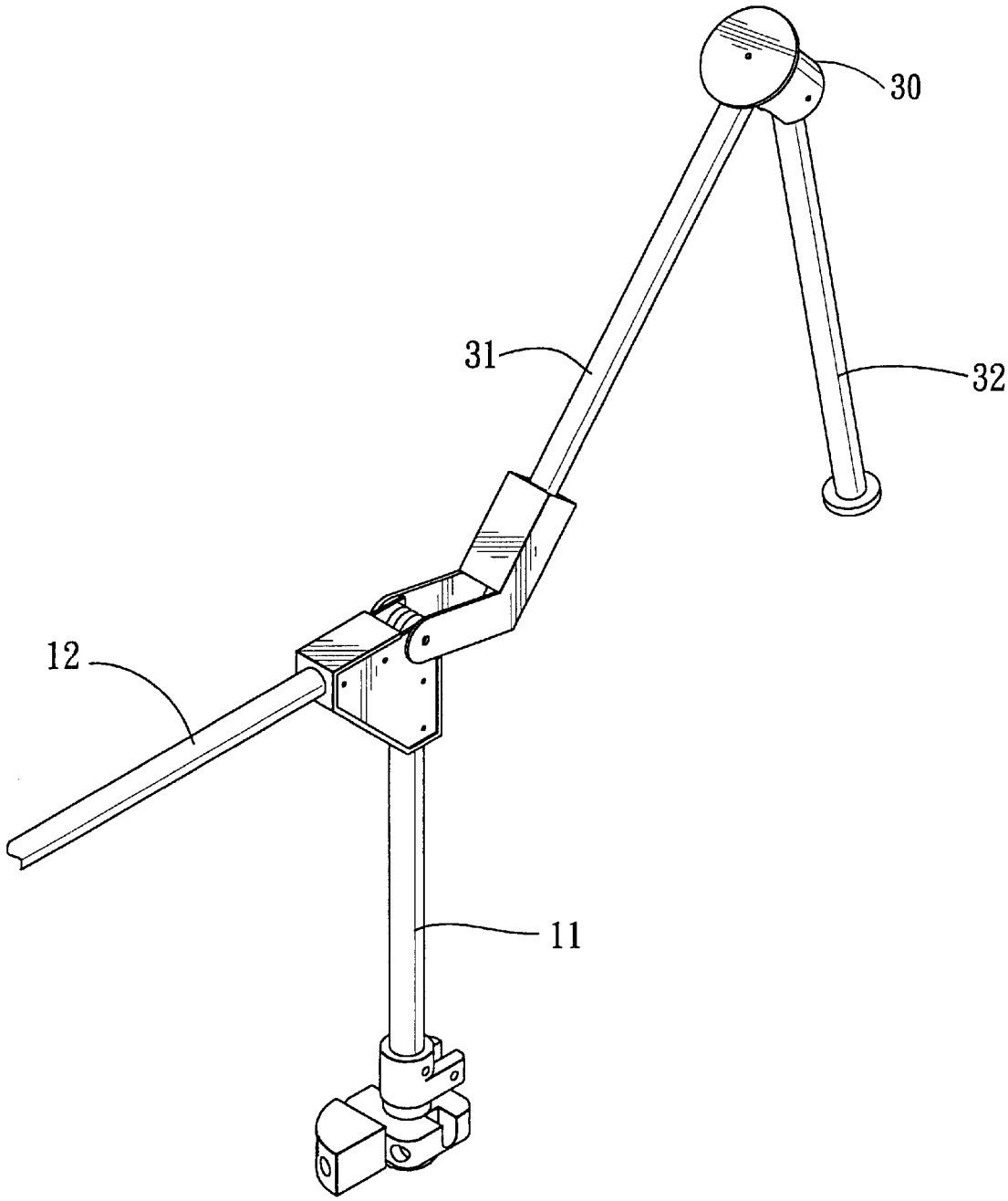
Figure 9:
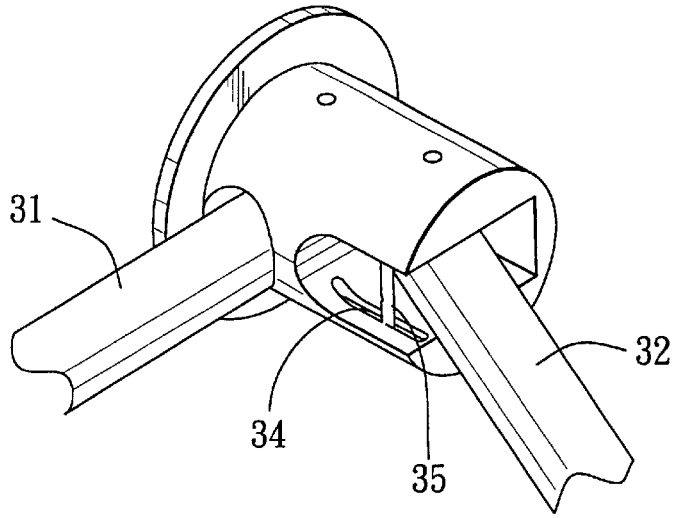

FIGS. 3 to 5 illustrate a preferred embodiment of a foldable bed of this invention. The foldable bed includes a foldable frame assembly, a belt unit 41 (see FIG. 10), and a mattress 4.

The foldable frame assembly includes: a plurality of parallel frame members 1, a plurality of coupling units 2, and a plurality of auxiliary supporting members 3.

The frame members 1 are aligned in a longitudinal direction, and each has left and right columns 11 and parallel upper and lower beams 12. Each of the left and right columns 11 extends in a vertical direction, and has opposite upper and lower column ends 111, 112 that are telescopically movable toward and away from each other (see FIGS. 3 and 5). The upper and lower beams 12 extend in a transverse direction, and interconnect the upper column ends 111 of the left and right columns 11 and the lower column ends 112 of the left and right columns 11, respectively.

Each of the coupling units 2 includes first left and right connecting rods 211, second left and right connecting rods 212, third left and right connecting rods 213, fourth left and right connecting rods 214, left and right upper joints 21, left and right lower joints 24, and a cross-rod 23. Each of the first left and right connecting rods 211 has a first upper rod end 2111 that is pivoted to the upper column end 111 of a respective one of the left and right columns 11 of one of two adjacent ones of the frame members 1, and a first lower rod end 2112 that is opposite to the first upper rod end 2111. Each of the second left and right connecting rods 212 has a second upper rod end 2121 that is pivoted to the upper column end 111 of a respective one of the left and right columns 11 of the other one of the two adjacent ones of the frame members 1, and a second lower rod end 2122 that is opposite to the second upper rod end 2121 and that is pivoted to the first lower rod end 2112 so as to permit folding and unfolding of the frame members 1 relative to one another in the longitudinal direction. Each of the third left and right connecting rods 213 has a third upper rod end 2131 and a third lower rod end 2132 that is opposite to the third upper rod end 2131 and that is pivoted to the lower column end 112 of a respective one of the left and right columns 11 of one of two adjacent ones of the frame members 1, and intersects a respective one of the first left and right connecting rods 211. Each of the fourth left and right connecting rods 214 has a fourth upper rod end 2141 that is pivoted to the third upper rod end 2131, and a fourth lower rod end 2142 that is opposite to the fourth upper rod end 2141 and that is pivoted to the lower column end 112 of a respective one of the left and right columns 11 of the other one of the two adjacent ones of the frame members 1. Each of the fourth left and right connecting rods 214 intersects a respective one of the second left and right connecting rods 212 so as to provide a stable supporting structure for the foldable frame assembly.

The first lower rod end 2112 of each of the first left and right connecting rods 211 and the second lower rod end 2122 of each of the second left and right connecting rods 212 are pivoted to each other via a respective one of the left and right lower joints 24. The third upper rod end 2131 of each of the third left and right connecting rods 213 and the fourth upper rod end 2141 of each of the fourth connecting rods 214 are pivoted to each other via a respective one of the left and right upper joints 21. The cross-rod 23 interconnects the left and right lower joints 24.

The auxiliary supporting members 3 are respectively pivoted to the frame members 1, and each includes a post 32 that is spaced apart from a respective one of the left and right columns 11 in the transverse direction and that has upper and lower post ends 321, 322, and parallel upper and lower rafters 31, 33 extending in the transverse direction. The upper rafter 31 has two opposite ends 311, 312 respectively pivoted to the upper post end 321 of the post 32 and the upper column end 111 of the respective one of the left and right columns 11. The lower rafter 33 has two opposite ends 331, 332 respectively pivoted to the lower post end 322 of the post 32 and the lower column end 112 of the respective one of the left and right columns 11 so as to permit folding and unfolding of each of the auxiliary supporting members 3 relative to the respective one of the frame members 1 in the transverse direction.

Referring to FIGS. 6 to 9, one of the opposite ends 311 of the upper rafter 31 and the upper post end 321 of the post 32 of each of the auxiliary supporting members 3 are pivoted to each other via a coupler 30. The coupler 30 includes a tubular body 301 that has top and bottom ends 3011, 3012 and that is formed with a notch 36 which extends upwardly from the bottom end 3012 toward the top end 3011 and which is confined by a notch-confining wall. The upper post end 321 of the post 32 of each of the auxiliary supporting members 3 extends into the bottom end 3012 of the tubular body 301. The tubular body 301 is further formed with a pair of opposing guide grooves 34 in the notch-confining wall. The guide grooves 34 have bottom ends adjacent to the bottom end 3012 of the tubular body 301. The tubular body 301 further has a bar piece 35 that has two opposite ends slidably retained in the guide grooves 34 in such a manner that the bar piece 35 falls down to the bottom ends of the guide grooves 34 (see FIG. 7) by virtue of gravity so as to prevent rotation of the post 32 relative to the tubular body 301 when the foldable frame assembly is positioned at an unfolding position and that the bar piece 35 can be lifted (see FIG. 9) by an external force so as to permit rotation of the post 32 relative to the tubular body 301.

Referring to FIGS. 3 and 4, a plurality of sliding members 25 are slidably and respectively mounted on the lower beams 12 of the frame members 1. A plurality of first and second stretchers 26, 27 are alternately disposed with and interconnect the frame members 1. Each of the first stretchers 26 has two opposite ends 261, 262 respectively pivoted to the lower column end 112 of a respective one of the left and right columns 11 of one of two adjacent ones of the frame members 1 and the sliding member 25 mounted on the lower beam 12 of the other one of the two adjacent ones of the frame members 1. Each of the second stretchers 27 intersects a respective one of the first stretchers 26, and has two opposite ends 271, 272 respectively pivoted to the lower column end 112 of a respective one of the left and right columns 11 of the other one of the two adjacent ones of the frame members 1 and the sliding member 25 mounted on the lower beam 12 of said one of the two adjacent ones of the frame members 1.

Figure 10:
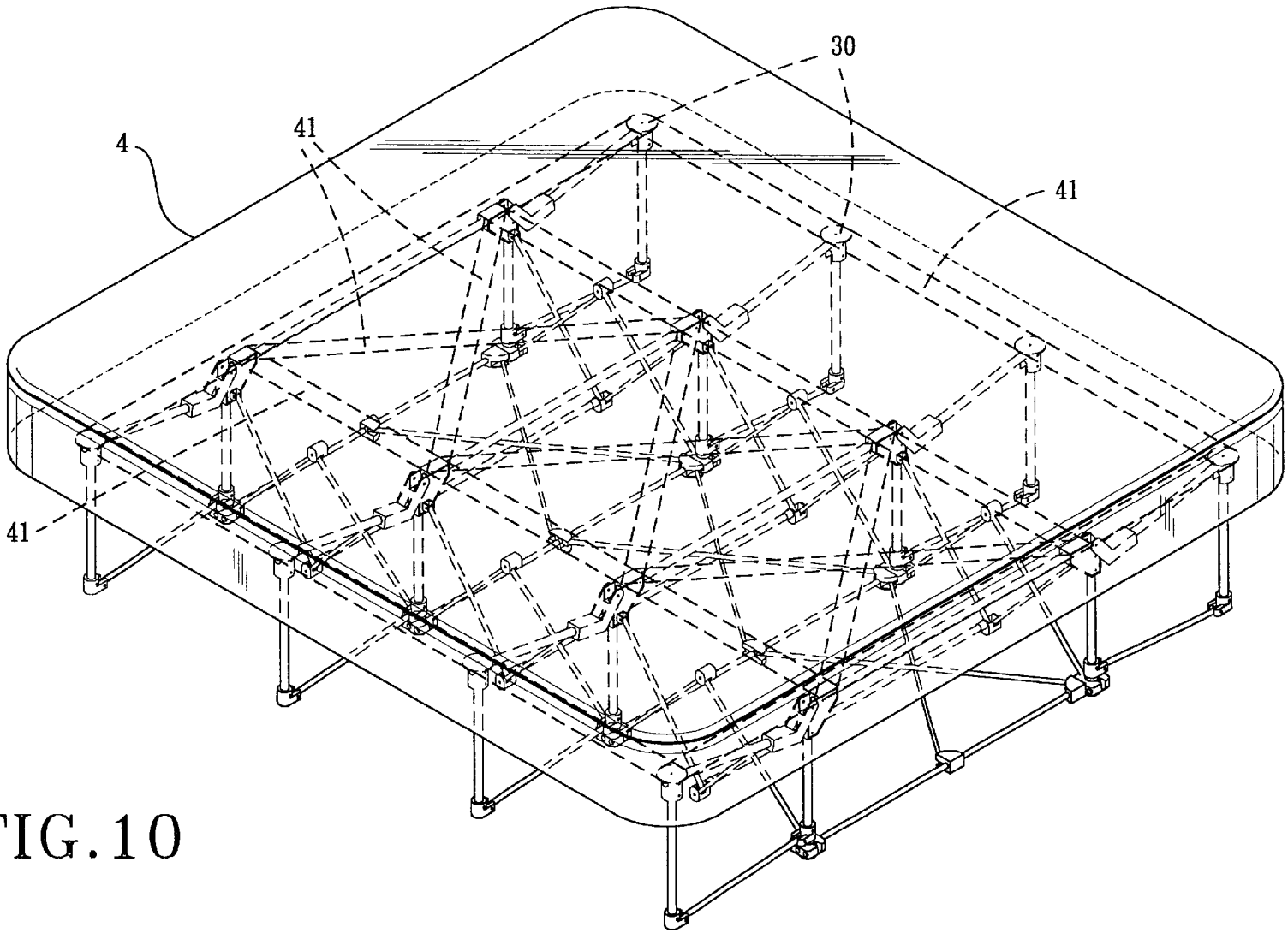
FIG. 10 is a perspective view of the foldable bed of FIG. 3 with a belt unit secured thereto.
Figure 11:
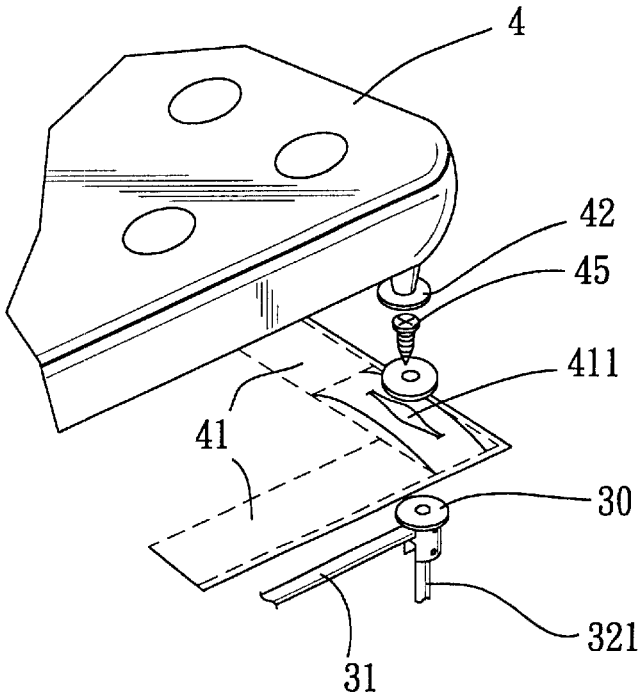
FIG. 11 is a fragmentary perspective view to illustrate how a mattress is secured to the belt unit of the foldable bed of FIG. 3 via a button unit.

Referring to FIGS. 10 and 11, the belt unit 41 includes a plurality of elastic belts which are arranged in rows and columns and which are detachably secured to the upper post ends 321 of the posts 32 via screw means 45 extending through the elastic belts and into the coupler 30 on the upper post end 321 of a respective one of the left and right posts 32. The mattress 4 is detachably secured to the belt unit 41 via a plurality of button units 42, each of which engages a slit 411 formed in the elastic belts at a position disposed over the upper post end 321 of a respective one of the posts 32.

Figure 12:
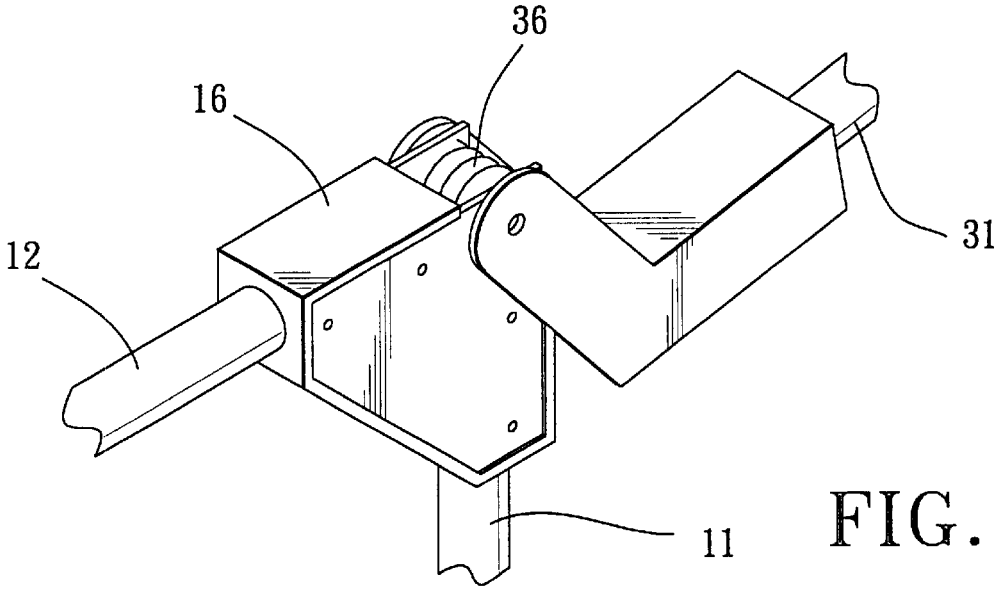
FIG. 12 is a fragmentary perspective view of the auxiliary supporting member of FIG. 6 with a torsion spring to facilitate folding of the auxiliary supporting member.

Referring to FIG. 12, a torsion spring 36 is mounted on a pivot joint 16 that interconnects the upper beam 12 and one of the left and right columns 11 of each of the frame members 1 for urging the upper rafter 31 of a respective one of the auxiliary supporting members 3 so as to facilitate folding of the auxiliary supporting members 3 relative to the frame members 1.

Figure 14:
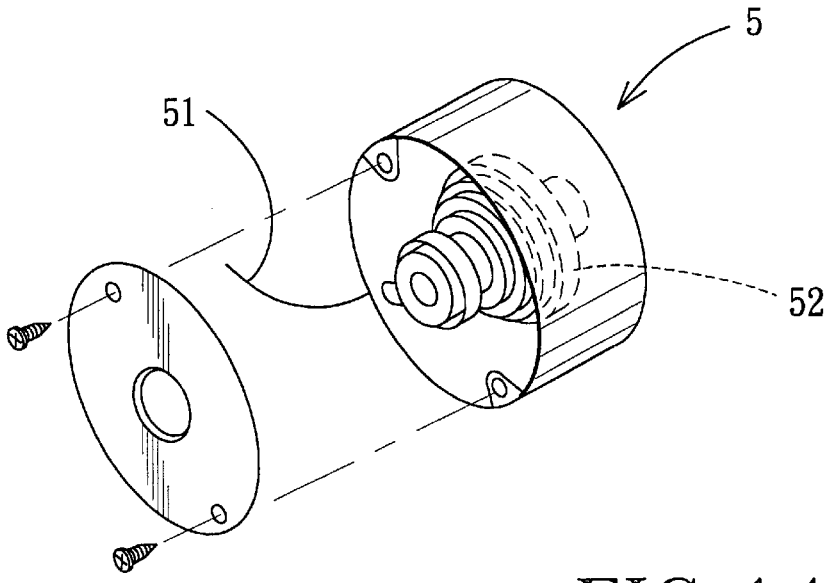
FIGS. 13 and 14 are perspective views of a restoring unit of the foldable bed of FIG. 3.
Figure 13:
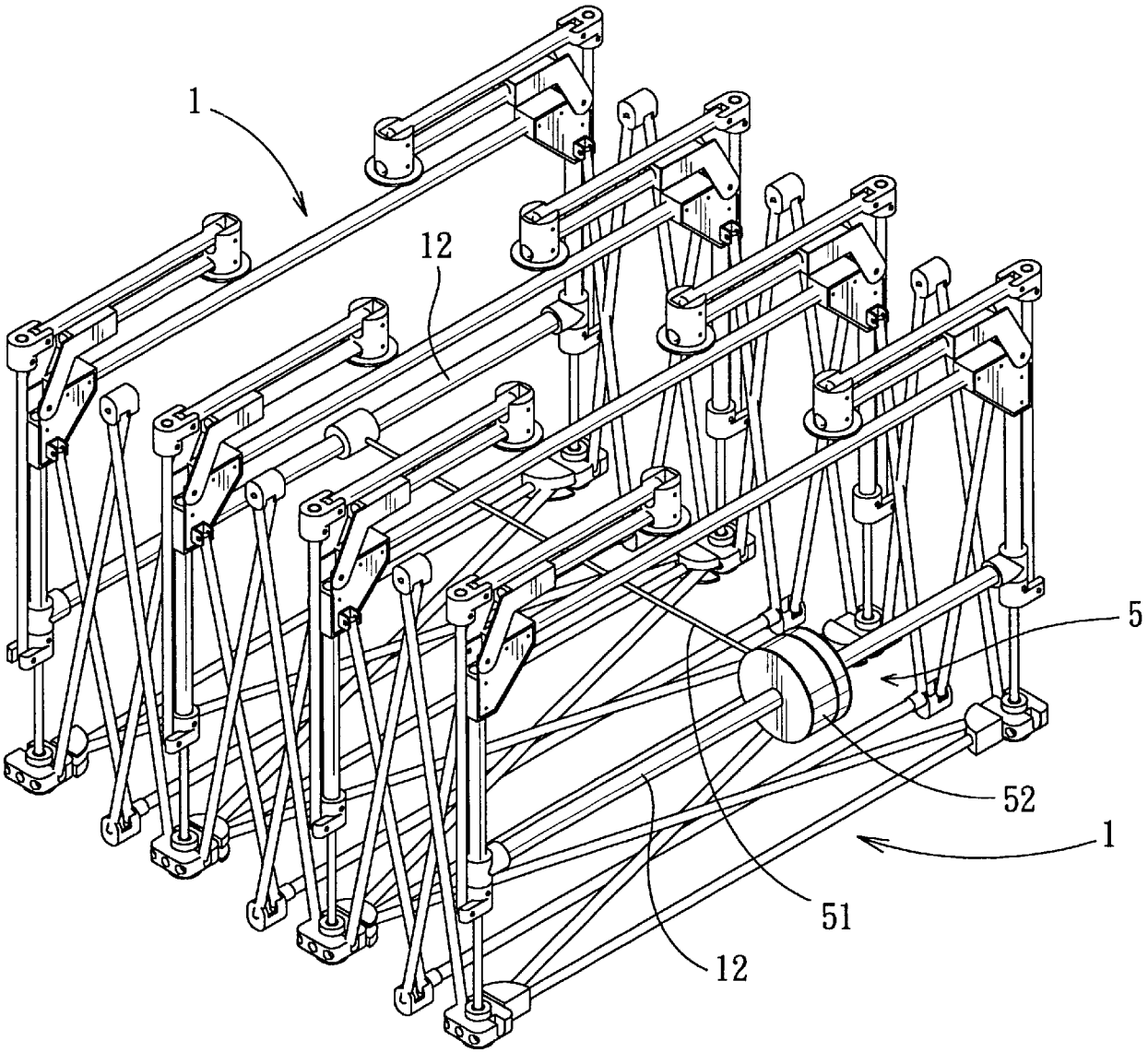

Referring to FIGS. 13 and 14, a restoring unit is mounted on the frame members 1, and includes a spring-biased reel 52 which is mounted on the lower beam 12 of a frontmost one of the frame members 1, and a line 51 which winds around the reel 52 and which has one end secured to the lower beam 12 of a rearmost one of the frame members 1 distal from the frontmost one of the frame members 1 so as to facilitate folding of the frame members 1 in the longitudinal direction.

Figure 15:
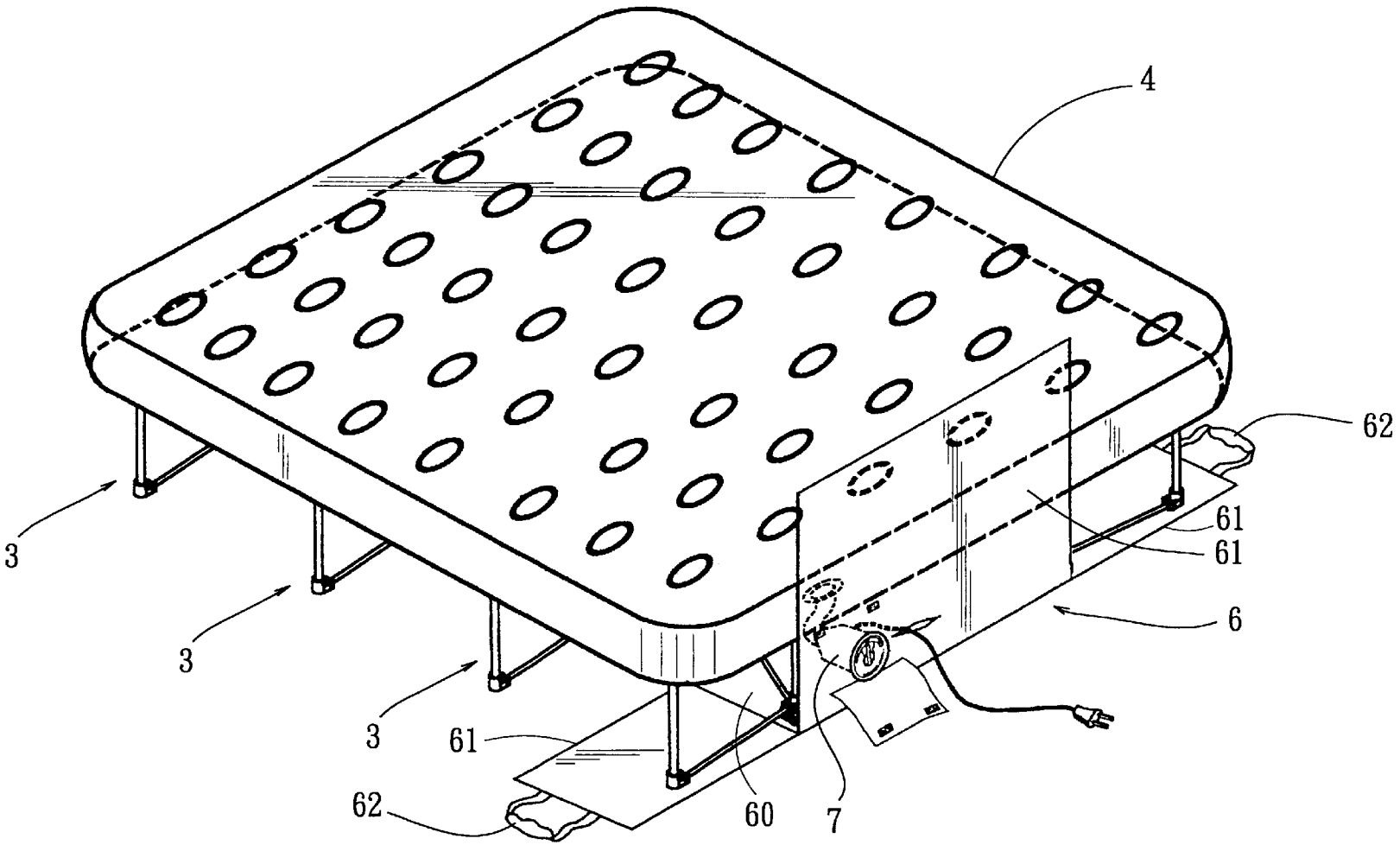
FIGS. 15 and 16 are perspective views of the foldable bed with an inflatable mattress and a plastic sheet that forms a casing to enclose the foldable frame assembly and the inflatable mattress when the foldable bed is folded.
Figure 16:
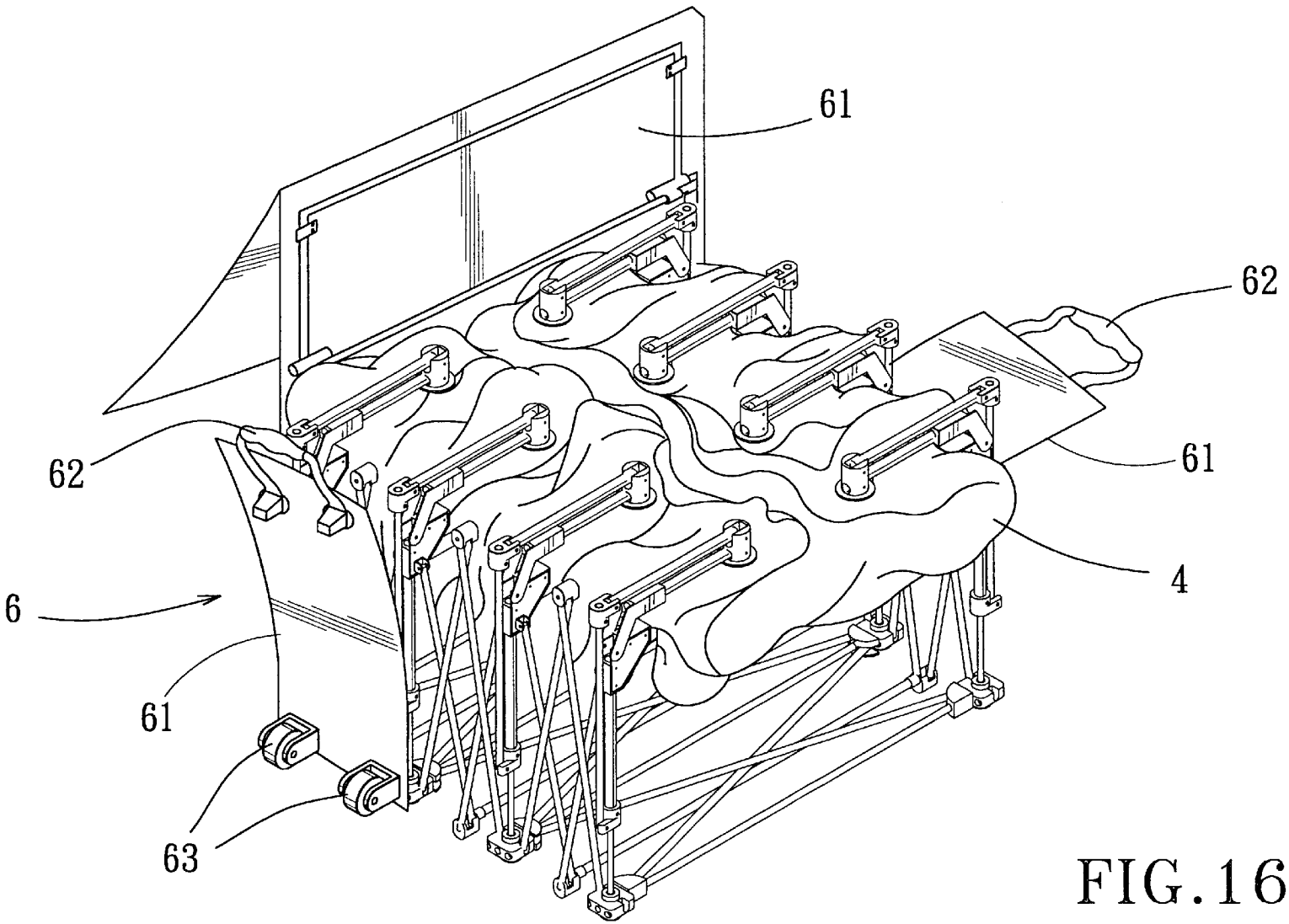

Referring to FIGS. 15 and 16, the mattress 4 is inflatable, and is provided with an air pump 7 which is mounted on a plastic sheet 6 for inflating the mattress 4. The plastic sheet 6 has a base portion 60 with a plurality of side edges, and a plurality of side portions 61 which extend from the side edges of the base portion 60, respectively, and which have peripheral edges that are interconnected via a closure unit (not shown) secured to and extending along lengths of the peripheral edges of the side portions 61 for enclosing the foldable frame assembly, the belt unit 41, and the inflatable mattress 4 when the foldable frame assembly is positioned at a folding position so as to facilitate transport of the foldable frame assembly. The plastic sheet 6 is provided with handles 62 and rollers 63 on the side portions 61.

With the inclusion of the upper and lower beams 12 and the coupling units 2 in the foldable frame assembly, the aforesaid drawbacks as encountered in the prior art can be eliminated.

With the invention thus explained, it is apparent that various modifications and variations can be made without departing from the spirit of the present invention. It is therefore intended that the invention be limited only as recited in the appended claims.

I claim:

1. A foldable frame assembly comprising:

a plurality of parallel frame members which are aligned in a longitudinal direction and each of which has left and right columns that extend in a vertical direction, each of said left and right columns having opposite upper and lower column ends that are telescopically movable toward and away from each other; and a plurality of coupling units which are alternately disposed with said frame members in the longitudinal direction and each of which includes:

first left and right connecting rods, each of which has a first upper rod end that is pivoted to said upper column end of a respective one of said left and right columns of one of two adjacent ones of said frame members, and a first lower rod end that is opposite to said first upper rod end, and second left and right connecting rods, each of which has a second upper rod end that is pivoted to said upper column end of a respective one of said left and right columns of the other one of said two adjacent ones of said frame members, and a second lower rod end that is opposite to said second upper rod end and that is pivoted to said first lower rod end so as to permit folding and unfolding of said frame members relative to one another in the longitudinal direction.

2. The foldable frame assembly of claim 1, wherein each of said coupling units further includes:

third left and right connecting rods, each of which has a third lower rod end that is pivoted to said lower column end of a respective one of said left and right columns of said one of said two adjacent ones of said frame members, and a third upper rod end that is opposite to said third lower rod end, and each of which intersects a respective one of said first left and right connecting rods, and fourth left and right connecting rods, each of which has a fourth lower rod end that is pivoted to said lower column end of a respective one of said left and right columns of said other one of said two adjacent ones of said frame members, and a fourth upper rod end that is opposite to said fourth lower rod end and that is pivoted to said third upper rod end, and each of which intersects a respective one of said second left and right connecting rods so as to provide a stable supporting structure for said foldable frame assembly.

3. The foldable frame assembly of claim 2, wherein each of said frame members further has parallel upper and lower beams extending in a transverse direction and interconnecting said upper column ends of said left and right columns and said lower column ends of said left and right columns, respectively.

4. The foldable frame assembly of claim 3, wherein each of said coupling units further includes left and right upper joints and left and right lower joints, said first and second lower rod ends being pivoted to each other via a respective one of said left and right lower joints, said third and fourth upper rod ends being pivoted to each other via a respective one of said left and right upper joints, each of said coupling units further including a cross-rod which interconnects said left and right lower joints.

5. The foldable frame assembly of claim 4, further comprising a plurality of auxiliary supporting members which are respectively pivoted to said frame members and each of which includes a post that is spaced apart from a respective one of said left and right columns in the transverse direction and that has upper and lower post ends, and parallel upper and lower rafters extending in the transverse direction, said upper rafter having two opposite ends respectively pivoted to said upper post end of said post and said upper column end of the respective one of said left and right columns, said lower rafter having two opposite ends respectively pivoted to said lower post end of said post and said lower column end of the respective one of said left and right columns so as to permit folding and unfolding of each of said auxiliary supporting members relative to the respective one of said frame members in the transverse direction.

6. The foldable frame assembly of claim 5, further comprising a plurality of sliding members that are slidably and respectively mounted on said lower beams of said frame members, and a plurality of first and second stretchers, each of said first stretchers having two opposite ends respectively pivoted to said lower column end of a respective one of said left and right columns of one of two adjacent ones of said frame members and said sliding member mounted on said lower beam of the other one of said two adjacent ones of said frame members, each of said second stretchers intersecting a respective one of said first stretchers, and having two opposite ends respectively pivoted to said lower column end of a respective one of said left and right columns of the other one of said two adjacent ones of said frame members and said sliding member mounted on said lower beam of said one of said two adjacent ones of said frame members.

7. The foldable frame assembly of claim 4, further comprising a plurality of auxiliary supporting members which are respectively pivoted to said frame members and each of which includes a coupler, a post that is spaced apart from a respective one of said left and right columns in the transverse direction and that has an upper post end pivoted to said coupler, and a rafter extending in the transverse direction and having two opposite ends respectively pivoted to said coupler and said upper column end of the respective one of said left and right columns so as to permit folding and unfolding of each of said auxiliary supporting members relative to the respective one of said frame members in the transverse direction, said coupler including a tubular body that has top and bottom ends and that is formed with a notch which extends upwardly from said bottom end toward said top end and which is confined by a notch-confining wall, said upper post end of said post extending into said bottom end of said tubular body, said tubular body being further formed with a pair of opposing guide grooves in said notch-confining wall, said guide grooves having bottom ends adjacent to said bottom end of said tubular body, said tubular body further having a bar piece that has two opposite ends slidably retained in said guide grooves in such a manner that said bar piece falls down to said bottom ends of said guide grooves by virtue of gravity so as to prevent rotation of said post relative to said tubular body when said foldable frame assembly is positioned at an unfolding position and that said bar piece can be lifted by an external force so as to permit rotation of said post relative to said tubular body.

8. The foldable frame assembly of claim 5, further comprising a belt unit that includes a plurality of elastic belts which are arranged in rows and columns and which are detachably secured to said upper post ends of said posts.

9. The foldable frame assembly of claim 8, further comprising a restoring unit that includes a spring-biased reel which is mounted on said lower beam of a frontmost one of said frame members, and a line which winds around said reel and which has one end secured to said lower beam of a rearmost one of said frame members distal from said frontmost one of said frame members.

10. A foldable bed comprising:

a foldable frame assembly including:

a plurality of parallel frame members which are aligned in a longitudinal direction and each of which has left and right columns and parallel upper and lower beams, each of said left and right columns extending in a vertical direction and having opposite upper and lower column ends that are telescopically movable toward and away from each other, said upper and lower beams extending in a transverse direction and interconnecting said upper column ends of said left and right columns and said lower column ends of said left and right columns, respectively;

a plurality of coupling units which are alternately disposed with said frame members in the longitudinal direction and each of which includes:

first left and right connecting rods, each of which has a first upper rod end that is pivoted to said upper column end of a respective one of said left and right columns of one of two adjacent ones of said frame members, and a first lower rod end that is opposite to said first upper rod end, second left and right connecting rods, each of which has a second upper rod end that is pivoted to said upper column end of a respective one of said left and right columns of the other one of said two adjacent ones of said frame members, and a second lower rod end that is opposite to said second upper rod end and that is pivoted to said first lower rod end, third left and right connecting rods, each of which has a third upper rod end and a third lower rod end that is pivoted to said lower column end of a respective one of said left and right columns of said one of said two adjacent ones of said frame members, and each of which intersects a respective one of said first left and right connecting rods, fourth left and right connecting rods, each of which has a fourth upper rod end that is pivoted to said third upper rod end, and a fourth lower rod end that is pivoted to said lower column end of a respective one of said left and right columns of said other one of said two adjacent ones of said frame embers, and each of which intersects a respective one of said second left and right connecting rods so as to provide a stable supporting structure for said foldable frame assembly, left and right upper joints and left and right lower joints, said first and second lower rod ends being pivoted to each other via a respective one of said left and right lower joints, said third and fourth upper rod ends being pivoted to each other via a respective one of said left and right upper joints, and a cross-rod interconnecting said left and right lower joints; and a plurality of auxiliary supporting members which are respectively pivoted to said frame members and each of which includes a post that is spaced apart from a respective one of said left and right columns in the transverse direction and that has upper and lower post ends, and parallel upper and lower rafters extending in the transverse direction, said upper rafter having two opposite ends respectively pivoted to said upper post end of said post and said upper column end of the respective one of said left and right columns, said lower rafter having two opposite ends respectively pivoted to said lower post end of said post and said lower column end of the respective one of said left and right columns; and a belt unit that includes a plurality of elastic belts which are arranged in rows and columns and which are detachably secured to said upper post ends of said posts.

11. The foldable bed of claim 10, further comprising an inflatable mattress detachably secured to said belt unit.

12. The foldable bed of claim 11, further comprising a plastic sheet that has a base portion with a plurality of side edges, and a plurality of side portions which extend from said side edges of said base portion, respectively, and which have peripheral edges that are capable of being interconnected for enclosing said foldable frame assembly, said belt unit, and said inflatable mattress when said foldable frame assembly is positioned at a folding position.

* * * * *